United States Patent [19]

Perron

[11] Patent Number: 4,776,049

[45] Date of Patent: Oct. 11, 1988

[54] HEAD SUPPORT

[76] Inventor: Therese H. Perron, 11 Veery Lane, Ottawa, Ontario, Canada

[21] Appl. No.: 39,109

[22] Filed: Apr. 16, 1987

[51] Int. Cl.[4] ..... A47C 20/02

[52] U.S. Cl. ..... 5/436; 5/437; 297/393

[58] Field of Search ..... 5/434–437, 5/442, 485, 490; 297/393, 397

[56] References Cited

U.S. PATENT DOCUMENTS

| | | | |
|---|---|---|---|
| 673,872 | 5/1901 | Hillern-Flinsch | 297/393 X |
| 941,043 | 11/1909 | Powell | 5/437 |
| 2,409,820 | 10/1946 | Zimmern | 5/437 X |
| 2,795,161 | 6/1957 | Weinman | 5/442 X |
| 3,608,964 | 9/1971 | Earl | 5/436 X |
| 3,789,546 | 2/1974 | Morrison | 5/485 X |
| 4,042,278 | 8/1977 | Jensen | 5/434 X |
| 4,345,346 | 8/1982 | Holtz | 5/437 |
| 4,617,691 | 10/1986 | Monti et al. | 5/437 X |
| 4,679,262 | 7/1987 | Davis et al. | 5/434 |

FOREIGN PATENT DOCUMENTS

| | | | |
|---|---|---|---|
| 429447 | 6/1924 | Fed. Rep. of Germany | 297/393 |

*Primary Examiner*—Gary L. Smith
*Assistant Examiner*—Michael F. Trettel
*Attorney, Agent, or Firm*—Sixbey, Friedman, Leedom & Ferguson

[57] ABSTRACT

A head support for a person in a seated position. The head support comprises a pair of elongated, stuffed fabric cushions to be seated, when in position, on the person's shoulders on either side of the person's neck. A first strap has its ends attached one to each cushion so as to extend between them behind the person's neck when the cushions are in position. A second strap is provided with one end secured to one cushion. Securing means associated with the other end of said second strap cooperate with securing means attached to the other cushion so the second strap is releasably securable to said other cushion. The second strap when in secured position extends between the cushions in front of the person's neck. The straps hold the cushions comfortably adjacent the person's neck to provide support for the person's head when the person is resting. The pillows may be shaped like animals to make them appealing to children.

22 Claims, 1 Drawing Sheet

HEAD SUPPORT

This invention relates to a head support for a person in sitting position, and more particularly relates to a device which may be used to support the head of a person when sleeping or resting in a chair, for example when in a car, bus or airplane.

BACKGROUND OF THE INVENTION

Conventional standard cushions for use by persons in sitting position, for example in airplanes, are not particularly comfortable and tend to fall out of place unless firmly wedged in position.

Persons, and particularly young children, whether travelling in airplanes, cars or other vehicles often fall asleep while sitting upright. The tendency is for their heads to droop forwardly or sideways, if unsupported, causing strain or discomfort to neck muscles if that position is maintained over a long period of time.

Recently there have been marketed a few types of inflatable pillows to be used by travellers. One such inflatable pillow is shaped in a flared arc that tucks beneath the chin, curves behind the head and nestles snugly on either the left or right shoulder. It is designed primarily as a head rest that can also be used for neck or lower back support. Another such inflatable pillow device used for resting the head inflates somewhat like a life jacket surrounding the neck on either side and at the back. Such inflatable pillow supports tend to be somewhat uncomfortable. They tend to slip out of ideal sleeping position. Being made of plastic, they tend to collect perspiration if they come into prolonged direct contact with a person's skin. As well, they possess the usual problems of inflatable objects, such as their vulnerability to rips or tears.

It is an object of the present invention to provide a novel construction of head support for use by persons in seated position in chairs and the like.

SUMMARY OF THE INVENTION

In accordance with the present invention there is provided a head support for a person in a seated position. The head support comprises a pair of elongated, stuffed fabric cushions to be seated, when in position, on the person's shoulders on either side of the person's neck. A first strap has its ends attached one to each cushion so as to extend between them behind the person's neck when the cushions are in position. A second strap is provided with one end secured to one cushion. Securing means associated with the other end of this second strap cooperate with securing means attached to the other cushion so the second strap is releasably securable to said other cushion. The second strap when in secured position extends between the cushions in front of the person's neck. The straps hold the cushions comfortably adjacent the person's neck to provide support for the person's head when the person is resting.

In a preferred embodiment of the present invention, the corresponding front ends of the cushions are bulbous and designed to fit below a person's chin when the cushions are in position on a person's shoulder. An animal form which is particularly appealing to children is a preferred shape of the cushions.

BRIEF DESCRIPTION OF THE DRAWINGS

These and other objects and advantages of the invention will become apparent upon reading the following detailed description and upon referring to the drawings in which.

Figure 1:
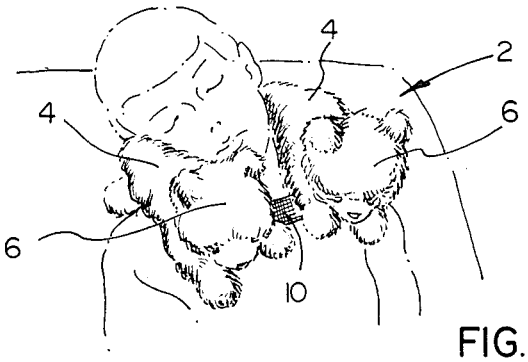
FIG. 1 is a perspective view of a head support in accordance with the present invention, in position resting on the shoulders of a seated child.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Turning to FIG. 1 there is shown in position on a child in sitting position, a head support 2 in accordance with the present invention. This head support comprises a pair of elongated, stuffed fabric cushions 4, each being in the shape of a toy cat in the illustrated embodiment. The two cushions, when in position on the person's shoulders as illustrated in FIG. 1, are intended to sit on either side of the person's neck. The bulbous portions 6 at the corresponding front ends of the cushions 4, formed by the heads of the cats, are intended to fit below the person's chin when in this position to provide comfortable support should the person's head droop forwardly when the person sleeps or rests and not too high so as to impede the person's view when using the support.

Figure 2:
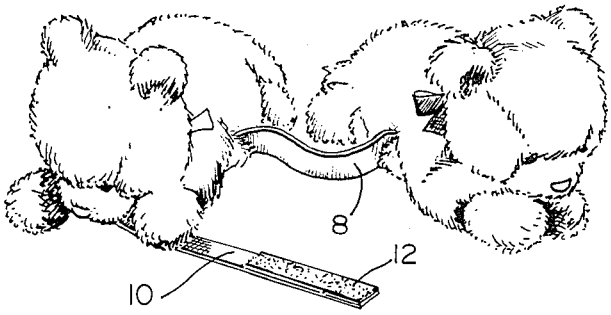
FIG. 2 is a perspective view of the head support of FIG. 1.

The cushions 4 are held in this position on the person's shoulders by rear fabric strap 8 and front fabric strap 10. Rear and front straps 8 and 10 may be made of any appropriate, preferably non-elastic material such as satin, or cotton. These straps should be made of a soft non-irritant fabric material such as satin, for comfort. The ends of rear fabric strap 8 are attached, as illustrated in FIG. 2, one to each of cushions 4 towards the rear of the cushions. Fabric strap 8 extends between the cushions behind the person's neck. It is preferred that strap 8 be stitched or otherwise secured to the cushions at an angle so that the strap will normally conform to the shoulder and neck profile of the person as the strap extends between the pillows. This adds to the comfort of the head support.

Figure 3:
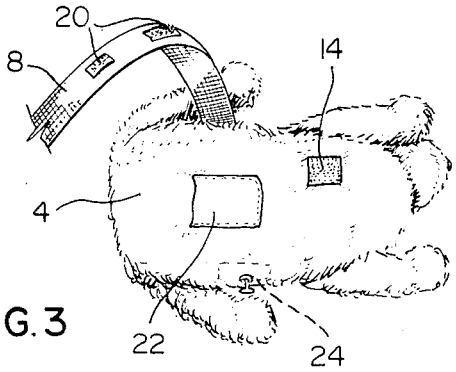
FIG. 3 is a bottom view of the head support of FIGS. 1 and 2.

Strap 10 has one end secured to one of the cushions 4 near the front end of that cushion. Pile fabric 12 is attached to a portion of strap 10 to cooperate with hooks 14 (FIG. 3) secured to a corresponding, front portion of the other cushion 4 at a location (e.g. underneath) where hooks 14 would normally not come into contact with the clothing or skin of the person wearing the head support. A "Velcro" (Trade Mark) pile fabric and hook securing means is suitable here. Using such a securing means, strap 10 may be releasably secured, at its free end, to the other cushion, thereby preventing the front portions of the cushions from spreading or otherwise falling out of position when the head support is in seated position on the wearer's shoulders. By providing pile fabric 12 over a good portion of strap 10, the length of strap 10 between the cushions 4 may thus be adjustable to the size of person using the support, the maximum comfort. Obviously, other types of conventional fastening means may be suitable, in place of pile fabric 12 and hooks 14. Straps 8 and 10 are intended to hold the cushions comfortably adjacent the person's neck to provide support for the person's head in the sideways or forwards direction, if that person is sleeping. (The chair in which the person is seated will normally provide sufficient support to the back of the person's head.)

Appropriate adjustment means such as a pile fabric and hook securing means 20 may be provided on the exterior surface of the rear strap 8 to permit the strap to be lengthened or shortened for maximum comfort of the wearer or to suit different sized persons.

A finger or hand-receiving pouch 22 may be provided on the underneath part of each of the cushions 4 (FIG. 3) to add interest to the cushions for a young child, for example to let the child hold onto the cushions or move them, puppet-like. A means, such as a wind-up or pressure actuated music device 24 may be inserted in one of the cushions 4 to add further appeal to a small child and assist in putting that child to sleep when wearing the head support.

The head support 2 in accordance with the present invention is particularly well-suited for young children who fall asleep while sitting in car seats or on the seats of automobiles, in airplane seats, etcetera. When the cushions 4 are in the form of animals or other toy objects of comparable shape, they are particularly appealing to children. The straps 8 and 10 are located so that they cannot become entangled about a child's neck. The use of "Velcro" (Trade Mark) or similar fasteners avoids the problems of typing a knot. The stuffed animals which form the cushions 4 for such application of course function simultaneously as toys to be played with by young persons. Of course, any appropriate shape of stuffed animal or other shape may be used. The material from which the cushions is made may be plush or cotton, but it must be stuffed to give a comfortable, cushion-like feeling. To protect the eyes of the person who uses it, each cushion should not have any decorative feature that could scratch or otherwise be hazardous, such as, for a cat, imitation whiskers. The cushions are preferably made of washable, non-toxic materials.

The size and shape of the cushion is important for the comfort of the wearer's neck and head. Rear strap 8 should be of a length which is just adequate to pass around a person's neck to sit the cushions on either side. The strap may be a ribbon, for example, 6½ inches long and 1 inch wide for a large person and 4½ inches long and 1 inch wide for a small person. Preferably the front strap 10 is 6½ inches long or longer. The length of each cushion 4 is preferably approximately 10 to 11 inches long, having a flat or somewhat concave bottom, to facilitate its being seated on the user's shoulders. The width of the cushion should be approximately 4 to 5 inches, with the top on the front end 6 of each cushion being higher, as previously indicated, for comfortable support of the user's chin.

The head support of the present invention may be designed for adults, in which case the pillows may have other than an animal form. They still, preferably, are contoured to have a bulbous front 6 to support a person's chin and be somewhat contoured concavely along their inner sides to fit comfortably about a person's neck.

A child or adult wearing a head support in accordance with the present invention is provided with additional support from the side and front a provide significantly increased comfort in sleeping.

Thus it is apparent that there has been provided in accordance with the invention a head support that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A head support for providing bilateral side and front support to the head of a person sleeping with the body oriented in a substantially vertical, upright position, said support comprising a pair of cushion means for supporting the head in a comfortable position when the body is in said vertical orientation, each said cushion means including a concave side portion, a bulbous front portion located at one end of said side portion, and a rear portion located at an opposite end of said side portion, a first longitudinal strap means for permanently attaching said cushion means together at a first location on said side portion of said cushion means spaced inwardly from said rear portion, a second longitudinal strap means for releasably securing said cushion means together at a second location on said cushion means spaced toward said front portion from said first location, and release means associated with said second strap means and said cushion means to permit the releasable attachment of said second strap means to said cushion means, wherein the concave side portion of each said cushion means is contoured to fit about the neck and shoulders, the bulbous front portion of each said cushion means is contoured to fit below the chin without obstructing vision, the first strapmeans is attached to each said cushion means to extend therebetween across the back of the neck to conform to the shoulder and neck profile, and said second strap means extends below the chin to maintain said concave side portion in place about the neck and shoulders and said bulbous front portion in place below the chin when said head support is positioned on the body.

2. A head support according to claim 1, wherein said first strap means includes adjustment means for varying the length of said strap means to permit the proper positioning of said cushion means concave side portion and bulbous front portion about the neck and shoulders and under the chin.

3. A head support according to claim 2, wherein said release means comprises an assembly of the two element hook and pile fabric type, wherein one element of said assembly is attached to said second strap means and the other element is attached to said cushion means.

4. A head support according to claim 3, wherein said release means includes adjustment means to adjustably fasten said second strap means to said cushion means to permit precise positioning of the bulbous portion to achieve maximum support.

5. A head support according to claim 4, wherein each of said cushion means is in the form of an animal and the bulbous front portion of said cushion means comprises the head of the animal.

6. A head support according to claim 1, wherein each of the cushions is in the form of an animal, and wherein the bulbous portion is the animal's head.

7. A head support according to claim 6 wherein the animals are in the form of kittens.

8. A head support according to claim 6 wherein a music box means is incorporated within at least one of the cushions.

9. A head support according to claim 6 wherein the straps are of non-elastic fabric and the cushions are of plush fabric.

10. A head support for a person in a sitting position comprising a pair of elongated, stuffed fabric cushions, each of said cushions including a bulbous front section, a rear section opposite said front section, first and second opposed side sections longer in length than said front or said rear section, connecting said front and rear sections, a top section and a bottom section, the first side section of each cushion to be positioned adjacent to the person's neck and the bottom section of each cushion to be positioned on the person's shoulders when the head support is operably seated in place; a first, longitudinal strap means extending between said cushions for permanently attaching said cushions together, wherein each end of said first strap means is attached to the first side of each cushion at a point along said first side spaced frontwardly from the rear section; and a second longitudinal strap means for releasably attaching said cushions together, wherein one end of said second strap means is attached to one cushion below said top section at a point spaced rearwardly from said front section and the other end of said second strap means includes securing means which engages corresponding securing means attached to the bottom of the other cushion at a point spaced rearwardly from said front section.

11. A head support according to claim 10, wherein each end of said first strap means is attached to the first side section of each cushion at an angle and is of a length so that the strap conforms to the shoulder and neck profile of the person when the support is operably seated in place.

12. A head support according to claim 10, wherein the bulbous front sections are sized to fit below the person's chin and to provide adequate support if the head droops forwardly without blocking the person's view when the support is operably seated in place with said second strap means secured.

13. A head support according to claim 12, wherein each of the cushions is in the form of an animal, the bulbous front section comprising the animal's head.

14. A head support according to claim 13, wherein the animal is a cat.

15. A head support according to claim 10, wherein said bottom section is substantially flat and said side section extends from said front bulbous section to said rear section in a substantially concavo-convex configuration.

16. A head support according to claim 10 wherein the securing means associated with the second strap and the cooperating securing means attached to said other cushion are of a hook and pile fabric type.

17. A head support according to claim 10 wherein a music box means is incorporated within at least one of the cushions.

18. A head support according to claim 10 wherein the straps are of non-elastic fabric.

19. A head support according to claim 18 wherein the straps are of soft non-irritant fabric.

20. A head support according to claim 18 wherein the cushions are made of plush fabric.

21. A head support according to claim 10 wherein a finger-receiving pouch is provided on the underside of each cushion.

22. A head support according to claim 10 wherein said first strap is provided with adjustment means to permit the length of the strap to be adjustable.

* * * * *